US006808088B2

(12) United States Patent
Chiu

(10) Patent No.: US 6,808,088 B2
(45) Date of Patent: Oct. 26, 2004

(54) SPIGOT DEVICE FOR A LIQUID CONTAINER

(75) Inventor: Brian Chiu, Kaohsiung (TW)

(73) Assignee: Fuu Hwa Vacuum Bottle Co., Ltd., Tainan (TW)

( * ) Notice: Subject to any disclaimer, the term of this patent is extended or adjusted under 35 U.S.C. 154(b) by 283 days.

(21) Appl. No.: 10/190,187

(22) Filed: Jul. 5, 2002

(65) Prior Publication Data

US 2004/0004094 A1 Jan. 8, 2004

(51) Int. Cl.[7] ..... B67D 5/38; B67D 3/00
(52) U.S. Cl. ..... 222/155; 222/518
(58) Field of Search ..... 222/155, 518; 137/558, 559

(56) References Cited

U.S. PATENT DOCUMENTS 1,512,971 A * 10/1924 Zolleis ..... 222/144.5
1,784,973 A * 12/1930 Preston ..... 222/155
5,944,225 A * 8/1999 Kawolics ..... 222/131

* cited by examiner

*Primary Examiner*—Kevin Shaver
*Assistant Examiner*—Stephanie Willatt
(74) *Attorney, Agent, or Firm*—Ladas & Parry LLP

(57) ABSTRACT

A spigot device for a liquid container includes a single-piece molded conduit confining a primary passage and a channel which are surrounded by an outer surrounding wall and which are not communicated with each other within the conduit. An intake end of each of the primary passage and the channel is in fluid communication with a bottom outlet of the container. An exit end of the primary passage is in fluid communication with a fluid passage in which a valve body is disposed to control flow of liquid from the container into a spout. An upright branch tube is in fluid communication with the channel to permit the liquid in the container to flow into the branch tube so that the level of the liquid in the container can be monitored by observing the level of the liquid in the branch tube.

5 Claims, 6 Drawing Sheets

SPIGOT DEVICE FOR A LIQUID CONTAINER

BACKGROUND OF THE INVENTION

1. Field of the Invention

This invention relates to a spigot device adapted to be mounted on a liquid container, more particularly to a spigot device with an upright branch tube to indicate the level of liquid in a liquid container.

2. Description of the Related Art

Referring to FIG. 1, a conventional hot water container is shown to include a vessel body 102 with a bottom outlet 105 for engaging one end of a connecting tube 103. A spigot device 1 includes a conduit 10 which has an outer surrounding wall 11 that defines a liquid passage 13 and a valve channel 14. The liquid passage 13 is disposed downstream of the other end of the connecting tube 103. A spout 16 extends into the outer surrounding wall 11, and is disposed downstream of the valve channel 14. An upright tube 15 is in fluid communication with the liquid passage 13 and a lower end of an upright water-level indicating branch tube 104 so that liquid into the vessel body 102 can flow in the branch tube 104 via the liquid passage 13. A valve body 101 is disposed in the valve channel 14 to control flow of liquid through the spout 16.

Although the level of the liquid in the vessel body 102 can be monitored by observing the level of the liquid in the branch tube 104, the liquid in the branch tube 104 that is exposed on the outside of the vessel body 102 is relatively cool, and may flow back into the liquid passage 13 to mix with the liquid in the liquid passage 13 to result in an undesirable reduction in the temperature of the liquid flowing out of the spout 16.

SUMMARY OF THE INVENTION

The object of the present invention is to provide a spigot device which can minimize flow of liquid in a branch tube into a spout to preventing undesirable reduction in the temperature of the liquid flowing out of the spout.

According to this invention, the spigot device includes a valve assembly which has an internal port, a spout disposed downstream of the internal port, a fluid passage disposed downstream of the internal port and upstream of the spout, and a valve body disposed in the fluid passage to control flow of liquid into the spout. An elongate conduit of a single-piece molded construction has an outer surrounding wall extending in a transverse direction. The conduit confines a primary passage and a channel surrounded by the outer surrounding wall. The primary passage has a first intake end adapted to be in fluid communication with a bottom outlet of a vessel body, and an exit end opposite to the first intake end and in fluid communication with the internal port of the valve assembly so as to permit the liquid in an accommodation space of the vessel body to flow into the internal port via the primary passage. The channel is not communicated with the primary passage within the conduit, and has a second intake end disposed adjacent to the first intake end and adapted to be in fluid communication with the bottom outlet of the vessel body, and a middle channel portion extending from the second intake end and terminating at a closed end. A branch tube extends in an upright direction, and defines a duct therein which has a lower end in fluid communication with the middle channel portion to permit the liquid in the accommodation space to flow into the duct so that the level of the liquid in the accommodation space can be monitored.

BRIEF DESCRIPTION OF THE DRAWINGS

Other features and advantages of the present invention will become apparent in the following detailed description of the preferred embodiment of the invention, with reference to the accompanying drawings, in which.

DETAILED DESCRIPTION OF THE PREFERRED EMBODIMENT

Figure 1:
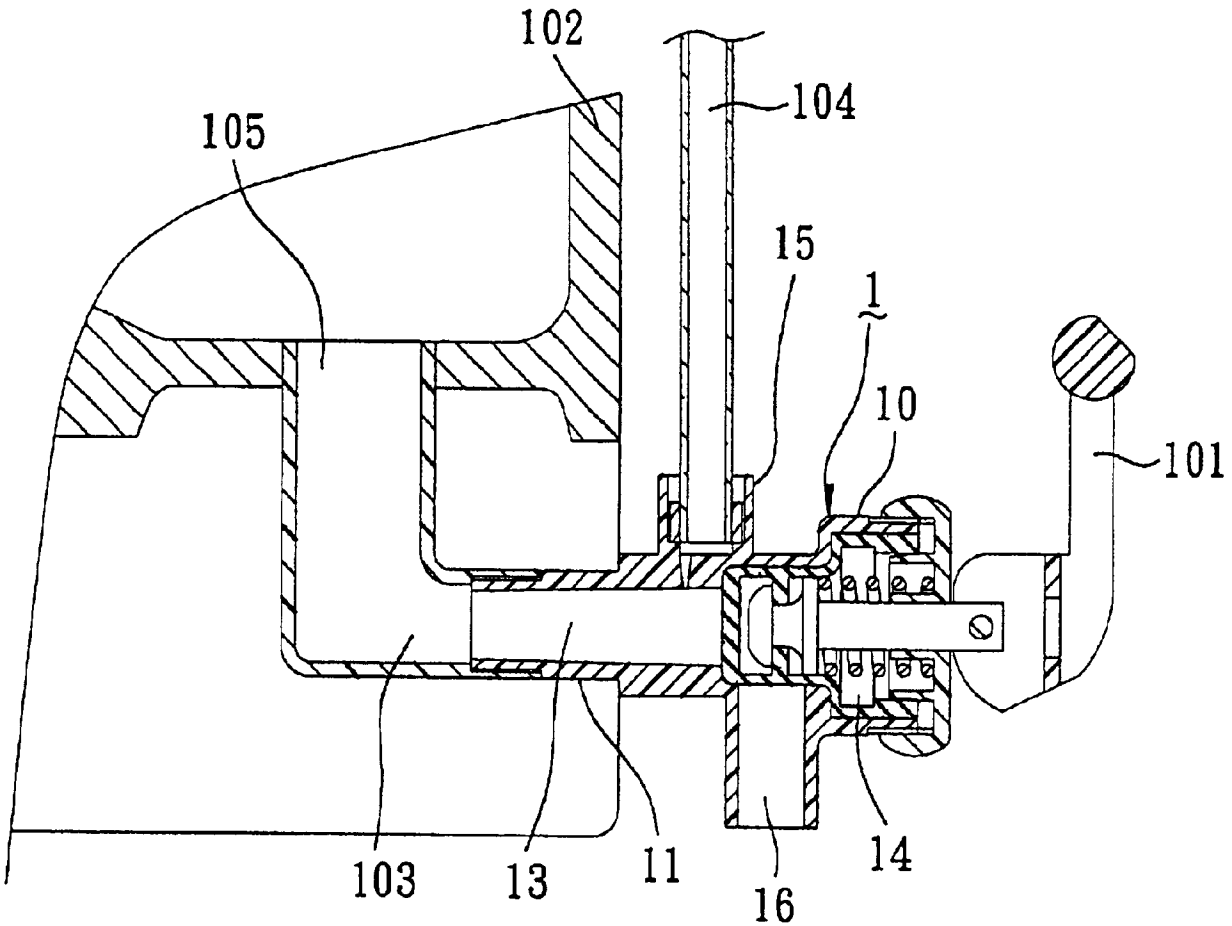
FIG. 1 PRIOR ART
FIG. 1 is a sectional view of a conventional hot water container with a spigot device.
Figure 2:
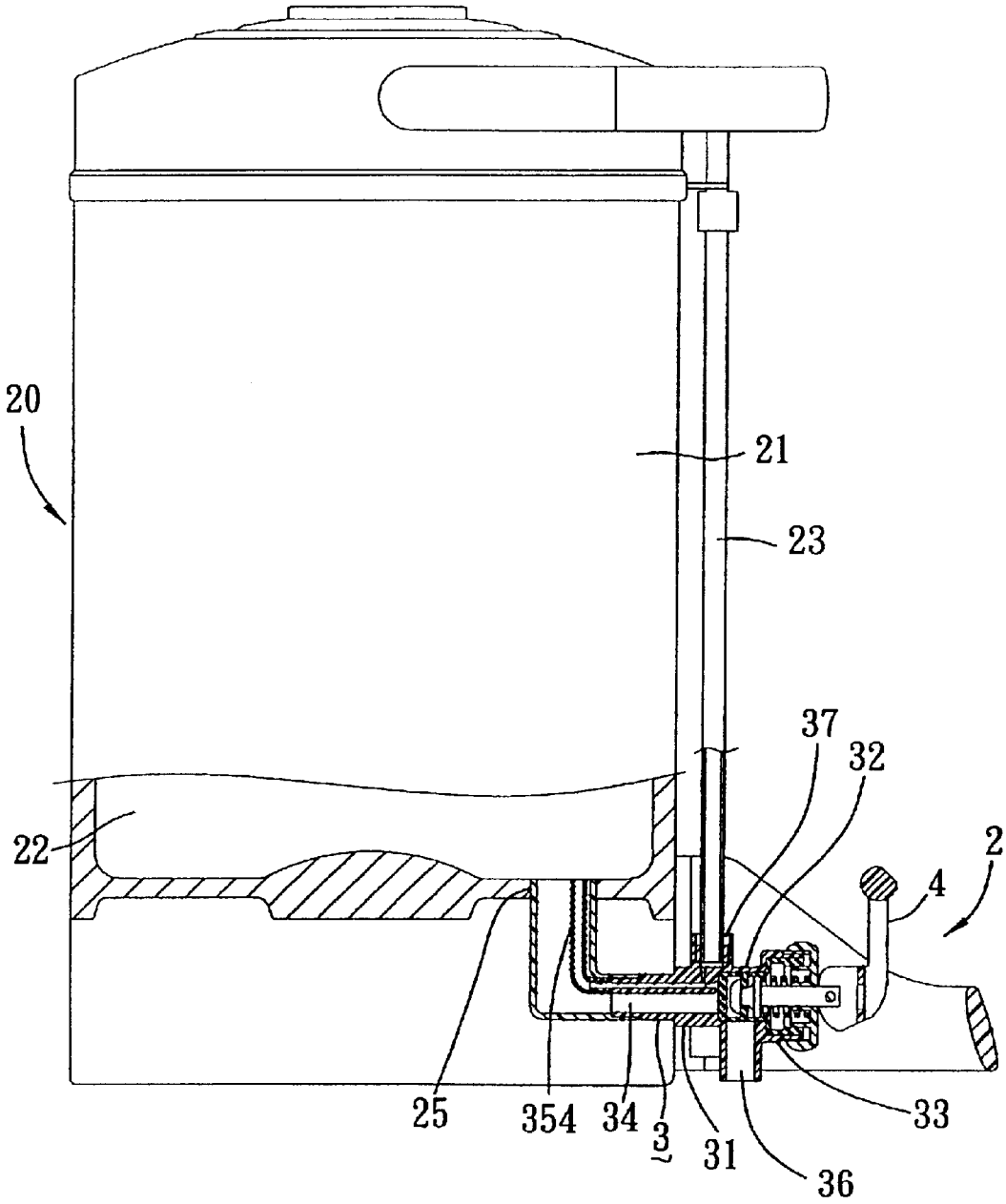
FIG. 2 is a sectional view of a preferred embodiment of a spigot device according to this invention when mounted on a liquid container.
Figure 3:
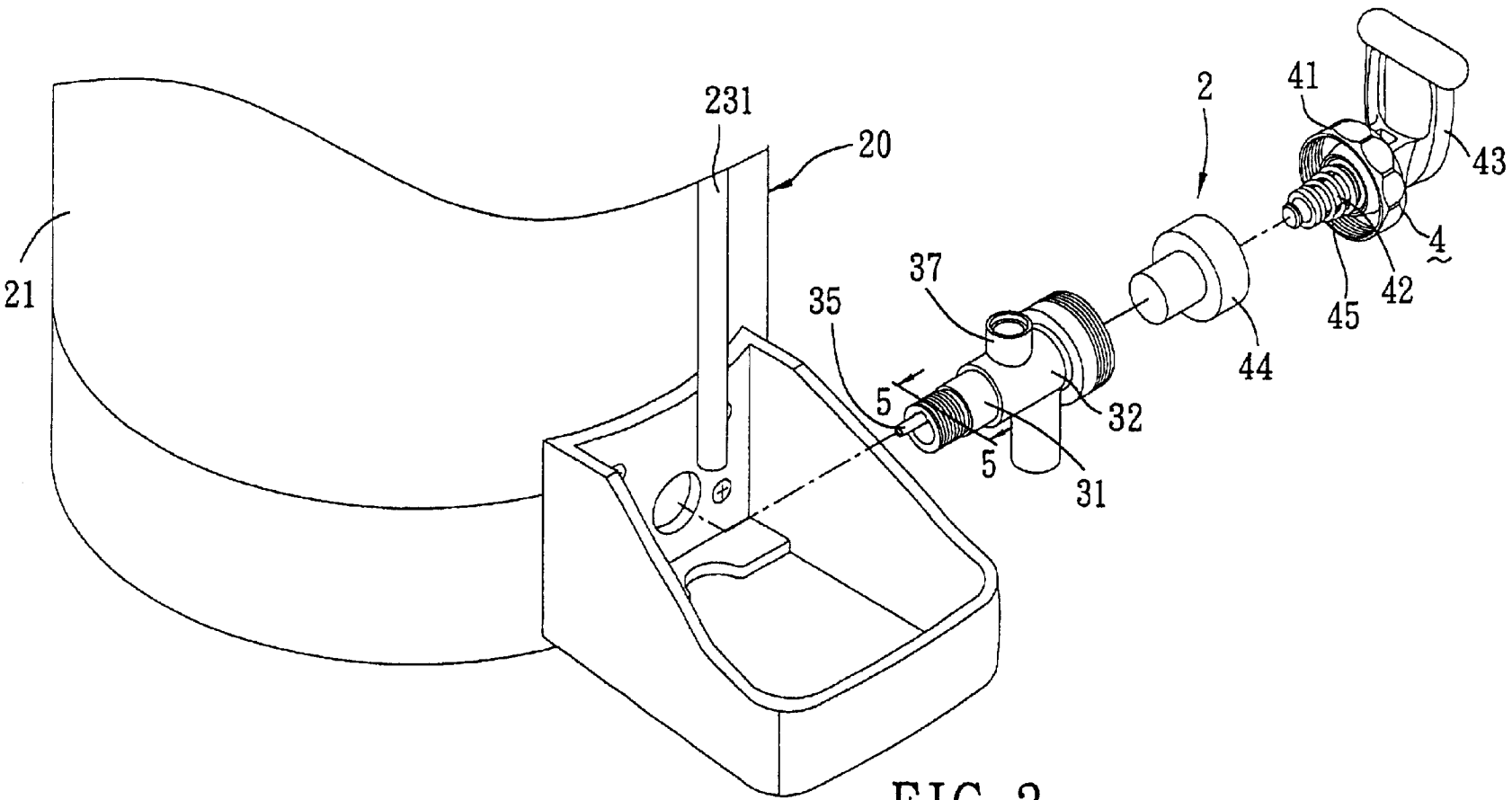
FIG. 3 is an exploded perspective view of the preferred embodiment.
Figure 4:
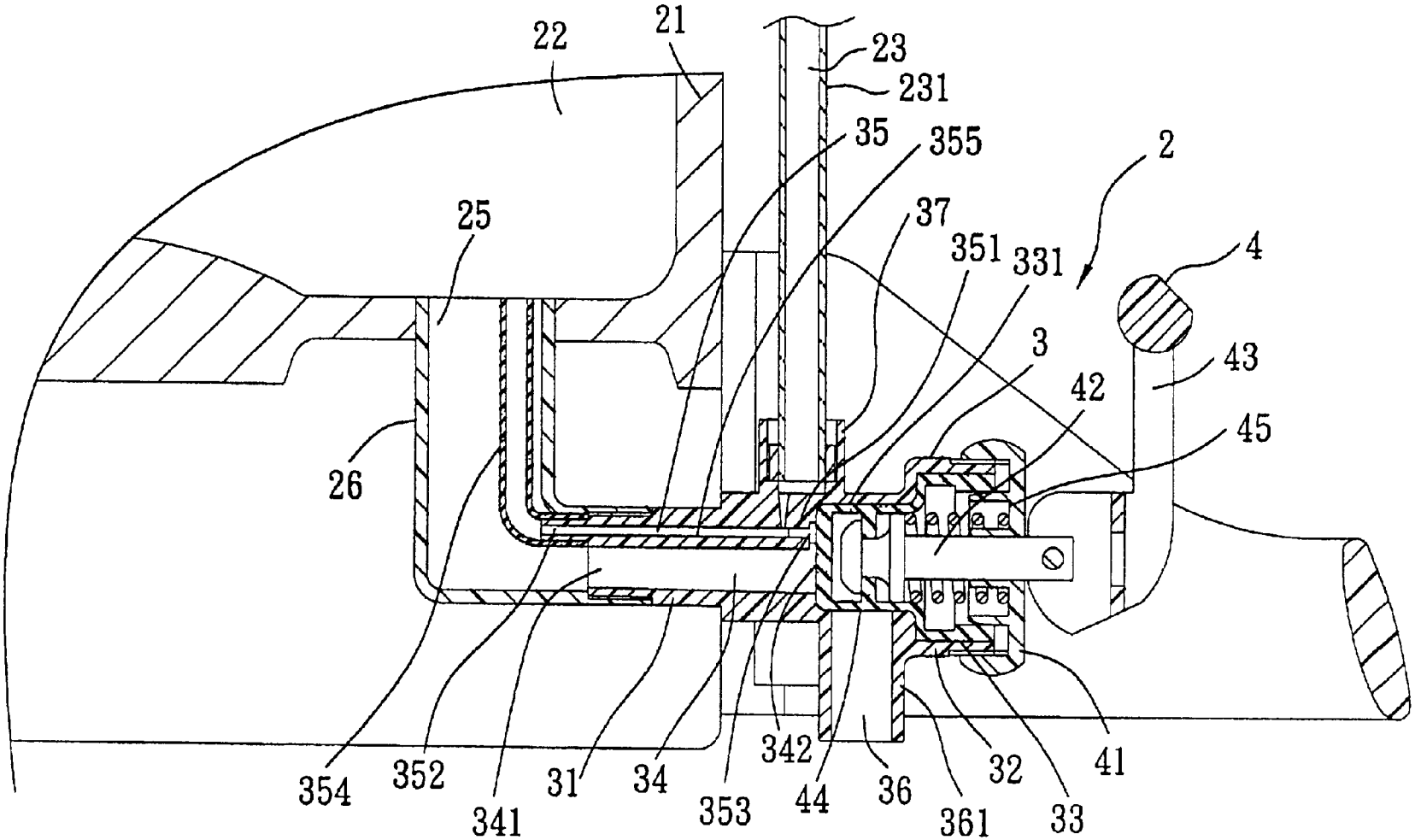
FIG. 4 is an enlarged view of a portion in FIG. 2.
Figure 5:
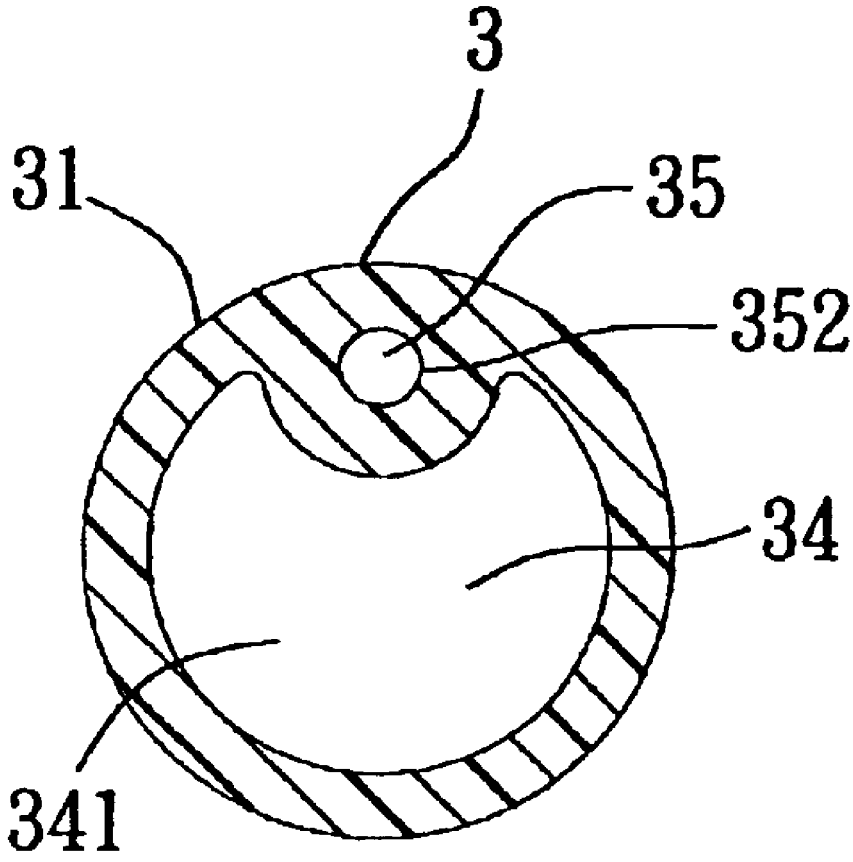
FIG. 5 is a sectional view of the spigot device shown in FIG. 2, taken along lines 5—5 thereof.

Referring to FIGS. 2 and 3, the preferred embodiment of a spigot device 2 according to the present invention is shown to be adapted to be mounted on a liquid container 20 which has a vessel body 21 defining an accommodation space 22 therein to receive liquid of a high temperature, such as hot water, and a bottom outlet 25 formed in a bottom of the vessel body 21. With reference to FIGS. 4 and 5, the spigot device 2 of this embodiment is shown to comprise an elongate conduit 3 of a single-piece plastic molded construction. The conduit 3 has an outer surrounding wall 31 which extends in a transverse direction, and confines a primary passage 34 and a channel 35 which are surrounded by the outer surrounding wall 31. The primary passage 34 has a first intake end 341 which is in fluid communication with the bottom outlet 25 via a connecting tube 26, and an exit end 342 which is opposite to the first intake end 341 in the transverse direction. The channel 35 is not communicated with the primary passage 34 within the conduit 3, and has a second intake end 352 which is disposed adjacent to the first intake end 341, and a middle channel portion 355 which extends from the second intake end 352 to terminate at a channel end 351 that has an insert hole oriented in line with the middle channel portion 355. A plug 353 is inserted into the insert hole so as to close the channel end 351. An L-shaped flexible tube 354 has a first tubular end which is connected to the second intake end 352, and a second tubular end which is inserted into the accommodation space 22 via the bottom outlet 25 of the vessel body 21 such that the channel 35 is in fluid communication with the accommodation space 22.

Further, an outer peripheral wall 32 is formed integrally with and extends from the outer surrounding wall 31 of the conduit 3 in the transverse direction to confine a fluid passage 33 therein with an internal port communicated with the exit end 342. A tubular wall 361 extends into the outer peripheral wall 32 in a direction radial to the transverse direction and is to be communicated with the fluid passage 33 so as to confine a spout 36 therein.

Figure 6:
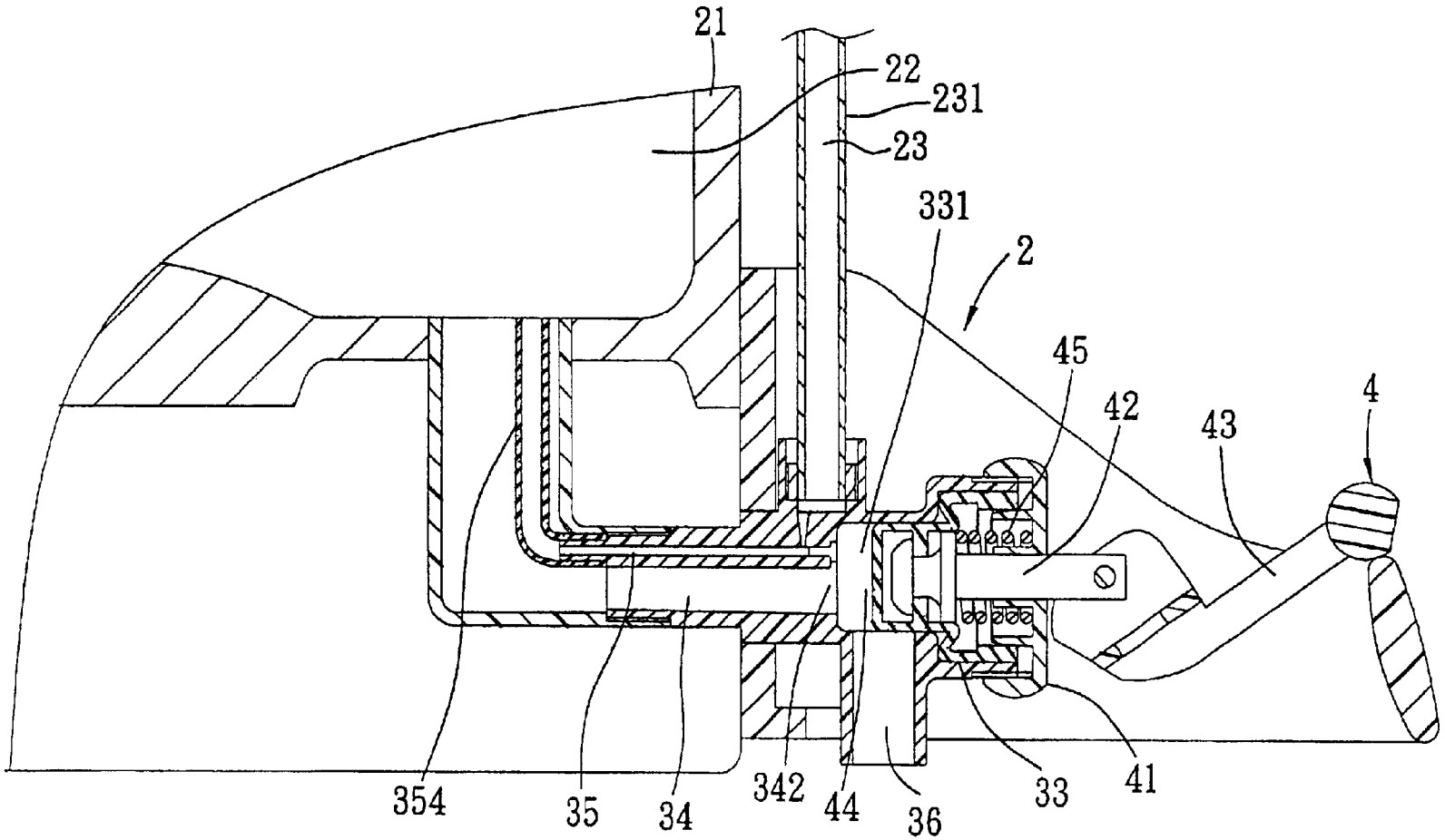
FIG. 6 is a sectional view similar to FIG. 5, showing the valve body in an open state.

Referring to FIGS. 4 and 6. a valve assembly includes the fluid passage 33, the spout 36, and a valve body 4. The valve body 4 includes a valve seat 331 which is disposed in the fluid passage 33 and downstream of the internal port, a valve disc 44 which is disposed movably in the transverse direction to engage and disengage the valve seat 331 so as to permit or interrupt communication between the exit end 342 and the spout 36, a stem 42 which has an inner end connected to the valve disc 44 and an outer end extending from the inner end in the transverse direction and outwardly of the outer peripheral wall 32 to be connected to a handle 43 that is operable externally, and a biasing member 45 which is sleeved on the stem 42 and which is disposed between the valve disc 44 and a positioning cap 41 to bias the valve disc 44 to engage the valve seat 331 so as to interrupt the communication between the exit end 342 and the spout 36. As such, operation of the handle 43 can control flow of the liquid from the accommodation space 22 into the spout 36 via the primary passage 34.

Moreover, a connecting tube portion 37 extends from and is formed integrally with the outer surrounding wall 31 to connect with a branch tube 231 which extends in an upright direction which is transverse to the transverse direction. The branch tube 231 defines a duct 23 therein which has a lower end that is in fluid communication with the middle channel portion 355 to permit the liquid in the accommodation space 22 to flow into the duct 23 via the channel 35 so that the level of the liquid in the accommodation space 22 can be monitored by observing the level of the liquid inside the branch tube 231.

As illustrated, since the channel 35 is not communicated with the primary passage 34 within the conduit 3, liquid in the channel 35, which is exposed on the outside of the vessel body 21, will not flow directly into the primary passage 34 to mix with the liquid flowing into the primary passage 34, whereby the temperature of the liquid flowing into the spout 36 can be maintained. Moreover, since the conduit 3 is formed of a single-piece molded construction, the assembly of the spigot device 2 to the container 20 is convenient.

While the present invention has been described in connection with what is considered the most practical and preferred embodiment, it is understood that this invention is not limited to the disclosed embodiment but is intended to cover various arrangements included within the spirit and scope of the broadest interpretations and equivalent arrangements.

I claim:

1. A spigot device adapted for a liquid container which includes a vessel body defining an accommodation space therein to receive liquid, and a bottom outlet formed in a bottom of the vessel body when the vessel body stands in an upright direction, said spigot device comprising:

a valve assembly having an internal port, a spout disposed downstream of said internal port, a fluid passage disposed downstream of said internal port and upstream of said spout, and a valve body disposed in said fluid passage to control flow of the liquid into said spout;

an elongate conduit of a single-piece molded construction, said conduit having an outer surrounding wall extending in a transverse direction that is transverse to the upright direction, said conduit confining a primary passage surrounded by said outer surrounding wall, and having a first intake end which is adapted to be in fluid communication with the bottom outlet of the vessel body, and an exit end which is opposite to said first intake end and which is in fluid communication with said internal port of said valve assembly so as to permit the liquid in the accommodation space to flow into said internal port via said primary passage, and a channel surrounded by said outer surrounding wall, and not communicated with said primary passage within said elongate conduit, said channel having a second intake end which is disposed adjacent to said first intake end and which is adapted to be in fluid communication with the bottom outlet of the vessel body, and a middle channel portion which extends from said second intake end and which terminates at a channel end; and a branch tube extending in the upright direction, and defining a duct therein which has a lower end that is in fluid communication with said middle channel portion to permit the liquid in the accommodation space to flow into said duct so that the level of the liquid in the accommodation space can be monitored.

2. The spigot device of claim 1, wherein said valve assembly includes an outer peripheral wall which extends from said outer surrounding wall of said conduit in the transverse direction to confine said fluid passage therein, and a tubular wall which extends into said outer peripheral wall in a direction radial to the transverse direction to communicate with said fluid passage so as to confine said spout therein.

3. The spigot device of claim 2, wherein said channel end is an open end, and further comprising a plug disposed to be inserted into said channel end.

4. The spigot device of claim 2, wherein said valve body includes a valve seat disposed in said fluid passage, a valve disc disposed to engage and disengage said valve seat so as to permit or interrupt communication between said exit end and said spout, a stem having an inner end which is connected to said valve disc and an outer end which extends from said inner end in the transverse direction and outwardly of said outer peripheral wall so as to be operable externally, and a biasing member disposed to bias said valve disc to engage said valve seat so as to interrupt the communication between said exit end and said spout.

5. The spigot device of claim 1, further comprising an L-shaped flexible tube which has a first tubular end connected to said second intake end, and a second tubular end adapted to be inserted into the accommodation space via the bottom outlet.

* * * * *